US006206746B1

(12) United States Patent
Wiggs et al.

(10) Patent No.: US 6,206,746 B1
(45) Date of Patent: Mar. 27, 2001

(54) CONTROL MEANS FOR TOY

(75) Inventors: Christopher Charles Wiggs; Christopher Joseph Crabtree Taylor, both of London (GB)

(73) Assignee: Origin Products Ltd., London (GB)

( * ) Notice: Subject to any disclaimer, the term of this patent is extended or adjusted under 35 U.S.C. 154(b) by 0 days.

(21) Appl. No.: 09/416,472

(22) Filed: Oct. 12, 1999

Related U.S. Application Data

(62) Division of application No. 09/140,866, filed on Aug. 27, 1998, now Pat. No. 6,102,767.

(30) Foreign Application Priority Data

Aug. 29, 1997 (GB) ..... 9718164

(51) Int. Cl.[7] ..... A63H 33/26
(52) U.S. Cl. ..... 446/135
(58) Field of Search ..... 446/135, 136

(56) References Cited

U.S. PATENT DOCUMENTS

| | | | |
|---|---|---|---|
| 1,323,232 | 11/1919 | Page | 446/135 |
| 2,036,076 | 3/1936 | Philippi | 446/135 |
| 2,138,367 | 11/1938 | Bonanno | 446/358 |
| 2,651,140 | 9/1953 | Kovac | 446/135 |
| 3,143,826 | 8/1964 | Ellis | 446/136 |
| 3,481,071 | 12/1969 | Hinkson | 446/135 |
| 3,638,357 | 2/1972 | Groh | 446/136 X |
| 3,657,457 | 4/1972 | Poynter | 434/63 |
| 3,757,467 | 9/1973 | Von Winckelmann | 446/135 |
| 3,785,648 | 1/1974 | Kobayashi | 273/108.51 |
| 3,946,520 | 3/1976 | Goldfarb et al. | 446/135 |
| 4,012,040 | 3/1977 | Fernandes | 273/108.56 |
| 4,189,864 | 2/1980 | Saito | 446/471 X |
| 4,208,833 | 6/1980 | Wolf | 446/136 |
| 4,834,371 | 5/1989 | Hay et al. | 446/139 |
| 4,878,878 | 11/1989 | Bittner | 446/330 X |
| 5,417,605 | 5/1995 | Chan | 446/136 |

FOREIGN PATENT DOCUMENTS

| | | | |
|---|---|---|---|
| 873003 | 4/1953 | (DE) | 446/135 |
| 1072548 | 9/1954 | (FR) | 446/135 |
| 1112934 | 11/1955 | (FR) | 446/135 |
| 1111975 | 3/1956 | (FR) | 446/135 |
| 2333410 | 7/1977 | (FR) | 446/444 |
| 669167 | 3/1952 | (GB) . | |

*Primary Examiner*—John A. Ricci
(74) *Attorney, Agent, or Firm*—Woodard, Emhardt, Naughton, Moriarty & McNett

(57) ABSTRACT

The invention relates to a toy comprising an article which is movable along a surface, the improvement of the article determined by a control, mounted under the surface. The control and article include magnetic materials to form a magnetic field between the two through the surface and which is sufficiently strong such that movement of the control exerts a moving influence on the article along, the surface. The control is provided with articulated joints which allow the control to follow and exert the moving influence on the article as it moves along different planes and levels of the surface, which was not previously possible. The control can also include particular lever arrangements which allow the proportion of the surface area upon which the control can exert the moving influence to be increased.

5 Claims, 3 Drawing Sheets

CONTROL MEANS FOR TOY

REFERENCE TO RELATED APPLICATION

This application is a divisional of U.S. patent application Ser. No. 09/140,866 filed Aug. 27, 1998 and entitled: "Control Means for A Toy", now U.S. Pat. No. 6,102,767.

FIELD OF INVENTION

The invention which is the subject of this application relates to a control means for use in controlling the movement of an article along a playbase which, in combination, form a toy. The toy is for use, typically by a child who, by manipulating the control means causes the remote movemnent of the article along the playbase. The control means are hidden from view with the exception of the portion which is to be manipulated so that the article appears to be moving independently. The article to be moved can be a scaled version of any of a human, animal or machine and the playbase can be shaped to define an environment or series of environments in which the child would expect to find the article in real life, thus adding to the realism.

BACKGROUND OF THE INVENTION

One known embodiment of a toy of this type is disclosed in Patent Application No. 9710939.1 in which the control means and article both include at least one magnet therein such that when the article and control means are placed in proximity, with the playbase intermediate, a magnetic field is created which is of sufficient strength so as to cause the article to "follow" the movement of the control means when powered. The control means includes a portion which is exposed to be moved by the child and said movement is translated by a pantograph arrangement to cause linear movement of the housing in which the magnet is contained.

A problem with the known form of control means is that the housing in which the magnet is mounted is only movable in the one, horizontal, plane and so the area of the playbase over which the article can be moved is also required to be substantially planar to ensure that the magnetic field strength is maintained at all times so that the article is still under the influence of the control means.

This restricts the shape of the playbase and hence environment which can be depicted and thus reduces the reaction of the environment depicted.

A second disadvantage is that the conventional control means, due to the arrangement of lever members relative to the portion which can be moved by the child, can only be moved within the bounds of a relatively restricted portion of the playbase. Thus, the article cannot be moved across the whole playbase and so once more the reaction of the toy is affected.

SUMMARY OF THE INVENTION

The aim of the invention is to provide a control means for an article to move the same along a playbase and to allow the control means to be of a form to allow the article to be remotely moved via the control means along a playbase which need not be planar. A further aim is to provide the control means in a form which allows the housing in which a magnet is provided to be swept across substantially all of the area of the playbase, and hence allows the article to move across substantially all of the playbase. A further aim of the present invention is to provide further realism and animation to the toy by causing the article to move both under the influence of the magnetic field and to have an additional component of movement. Said additional component of movement is typically representative of movement found in the real life article depicted in the toy.

In a first aspect of the invention there is provided a toy, said toy comprising a playbase, an article moveable along the top of said playbase, a control means provided under said playbase to exert a moving influence on said article and wherein said control means is articulated to allow said means to substantially follow a non-planar playbase and for the article to be moved along the same.

In one embodiment the top of the playbase includes undulating, and/or sloped non-planar portions for the article to move along and said control means is articulated to allow the same to substantially follow the underside of the playbase which is shaped in a similar manner to the top side of the playbase thereby allowing the moving influence to be maintained on the article on the top of the playbase as it moves therealong.

In one embodiment the article includes at least one magnet mounted therein and the control means includes at least one magnet mounted thereon. Typically the magnet is mounted in a housing located at the distal end from the point of actuation of the control means and the articulation is provided between the point of actuation and the distal end so as to allow the distal end of the control means to follow the steps of the underside of the playbase.

In one embodiment there is mounted on the underside of the playbase, guide means which guide the distal end to follow the shape of the underside of the playbase.

In one embodiment the control means includes one or a series, of ball joints which are spaced so as to allow the required extent of actuation.

In a further aspect of the invention there is provided a toy comprising an article, a playbase and control means, to exert a magnetic moving influence on the article to move the same along the playbase, said control means provided on the underside of said playbase and including at its distal end a magnet to create a magnetic field with a magnet in said article and wherein said control means comprises an actuating means connected with a plate for imparting a movement comprising a limited rotating action relative to a second plate, and a linear movement relative to the playbase and said second plate is capable of limited linear movement relative to said playbase and is connected to a series of lever members, on which said magnet is mounted, and at least one of said lever members is secured to, and is pivotally movable in relation to the playbase, thereby allowing the at least one magnet of the control means to be movable about the playbase.

This arrangement typically allows the at least one magnet of the control means to be moved about substantially the whole of the underside of the playbase surface and therefore increases the available area for movement of the article in comparison to conventional control means.

Typically the rotating movement of the second plate relative to the first plate is limited to the movement of a pin in one of the first or second plates along an arcuate slot in the other of the first or second plates.

Typically the linear movement of the first and second plates relative to the playbase is determined by the movement of pins along linear slots in a planar member enclosing the control means with the playbase.

Specific embodiments of the invention will now be described with respect to the accompanying drawings, wherein:

DETAILED DESCRIPTION OF THE PREFERRED EMBODIMENTS

Figure 1:
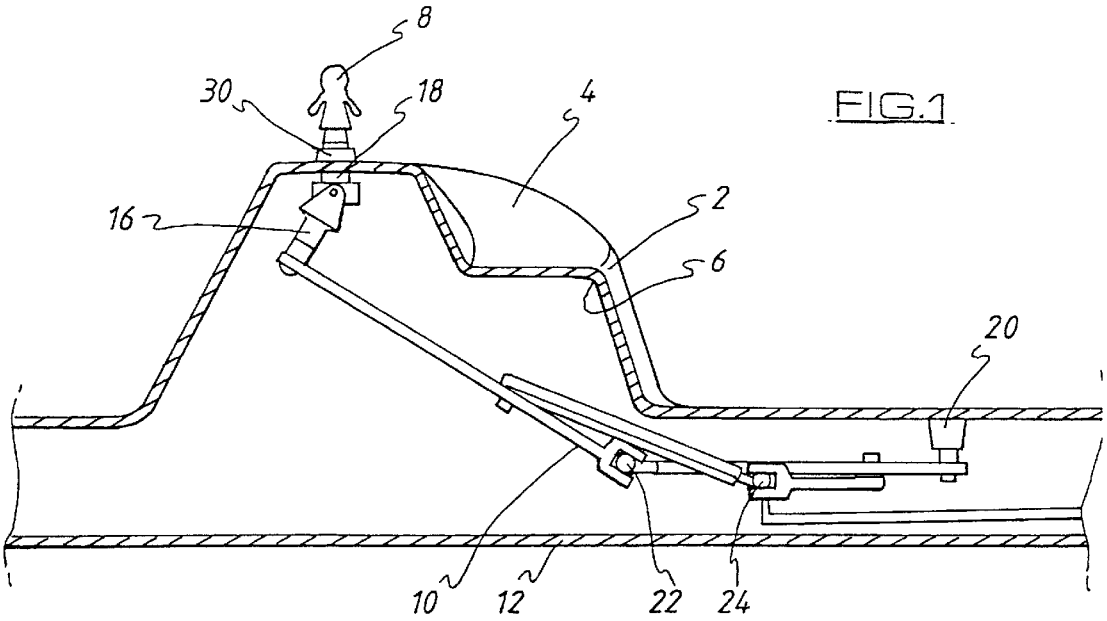
FIG. 1 illustrates a sectional view of the toy in one embodiment of one aspect of the invention.
Figure 2:
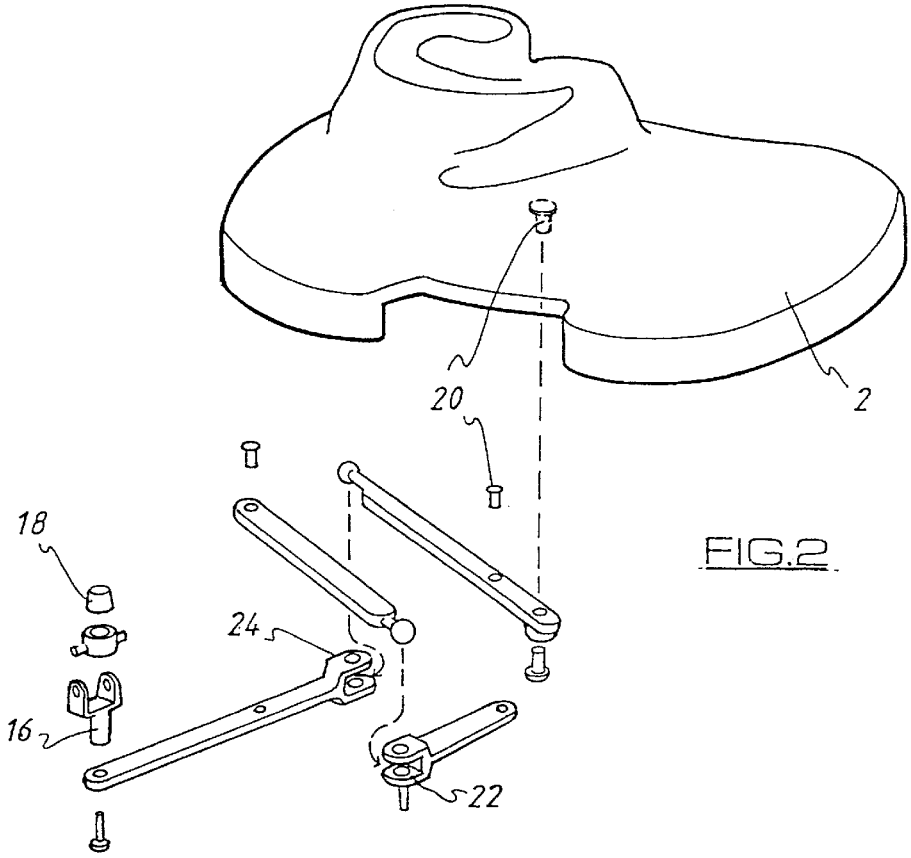
FIG. 2 illustrates an exploded view of the components of the toy of FIG. 1.

Referring firstly to FIGS. 1 and 2, there is shown a toy according to a first aspect of the invention. The toy comprises a playbase 2 which has a top side 4 which is shaped and an underside 6 which is shaped in substantially the same manner as the top side 4. On the top side 4 of the playbase there is provided an article 8 which is provided to be moved along said top side. On the underside of the playbase there is provided a control means 10 which is enclosed by a panel 12.

The control means 10 comprises a series of lever members which are interconnected, and at one end there is provided a housing 16 in which a magnet 18 is mounted in a pivotal manner and at the other end of the control means there is provided an actuating means (not shown) which protrudes through the play base 2 to allow the same to be manipulated manually to cause movement of the control means relative to the playbase. The lever members arrangement is also secured to be pivotally movable relative to the playbase via pin 20 and the lever members are relatively pivotal. The control means also includes ball joint pivot points 22, 24 to allow the articulation of the control means. The articulation of the control means provides the ability for the housing 16 and magnet 18 to be articulated and movable in a non planar manner to follow the shape of the underside 6 of the playbase. This movement can be assisted by the provision of guide means (not shown) formed on the underside of the playbase.

The article 8 is also provided with a magnet 30 in the base thereof and said magnet is arranged relative to the magnet 18 of the control means such that when the article is placed on the playbase and the control means magnet 18 is in proximity, as shown in FIG. 1, the article is attracted to contact with the playbase. The attraction is required to be sufficiently strong such that, when the control means magnet 18 is moved by actuating the control means, the article overcomes friction and moves under the influence of the magnetic force to follow the path of the magnet 18. In this manner the article appears to be moving independently across the playbase 2 with no external forces applied as the control means are hidden and controlled from a point remote to the article. It will be apparent that this is of particular appeal to children. In addition, and according to this aspect of the invention, the provision of the articulated control means allows the control means magnet 18 to follow a non planar underside 6 of the playbase 2 and hence allow the magnet to be sufficiently close to the playbase to maintain the strength of the magnetic field with the magnet 30 of the article 8 such that when the magnet 18 is moved, the article follows and so the article can be moved around non-planar surfaces as shown in FIG. 1.

Figure 3:
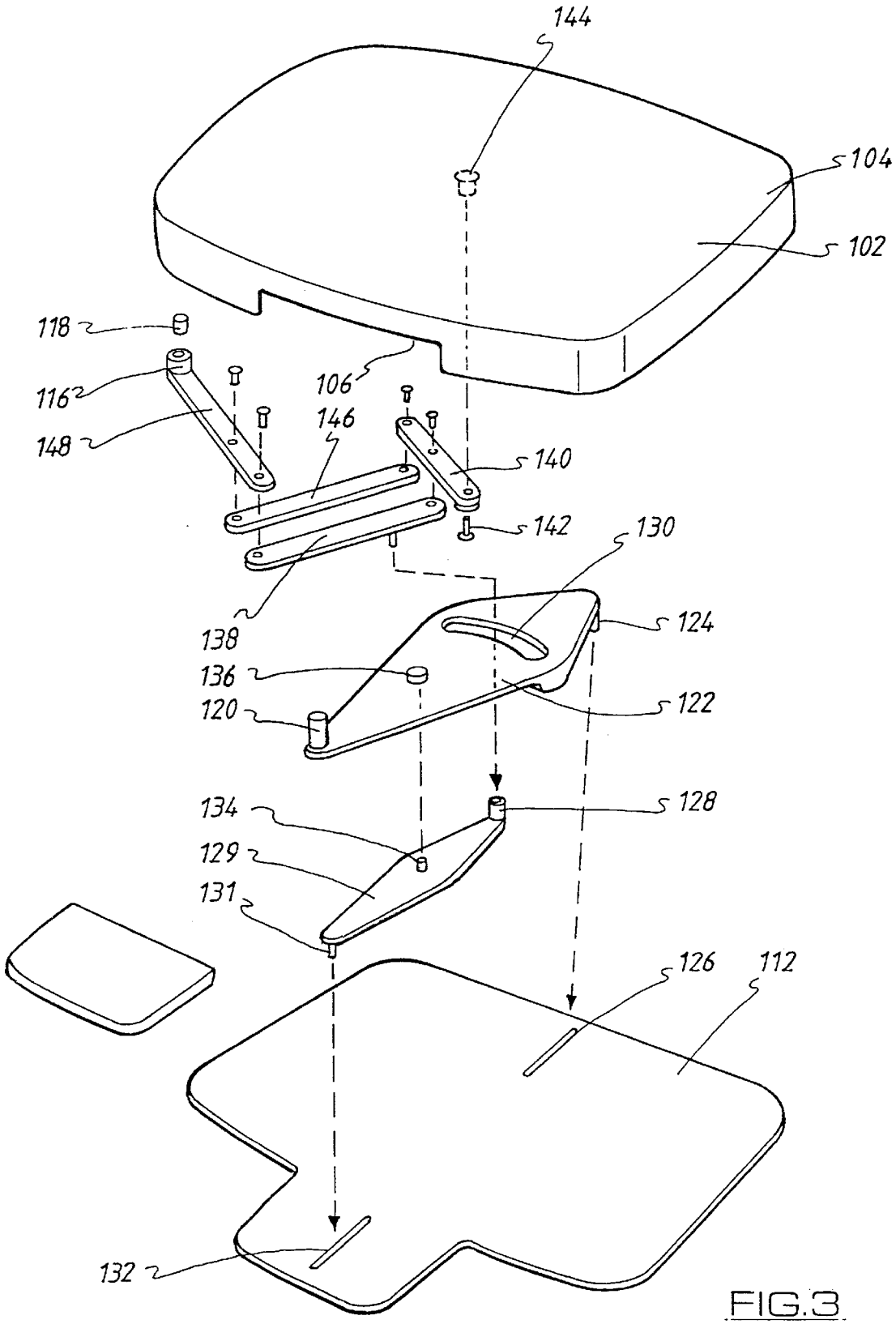
FIG. 3 illustrates an exploded view of the toy according to a second embodiment.
Figure 4:
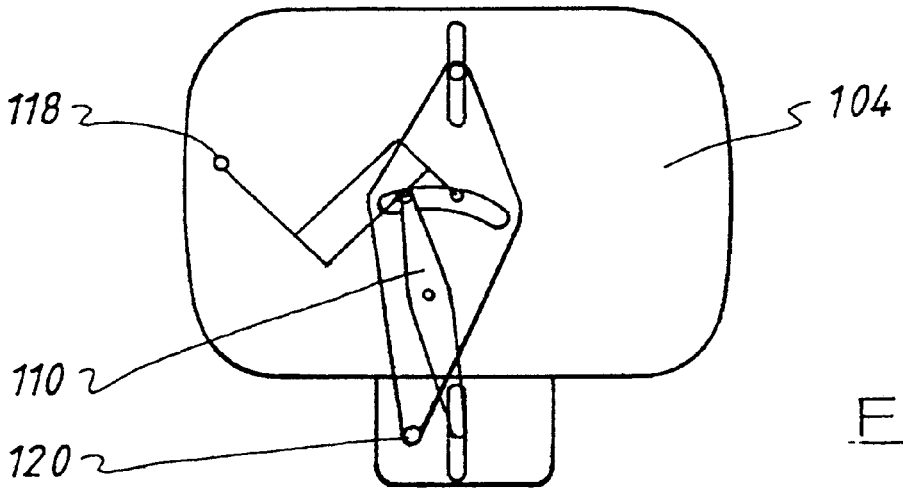
FIG. 4 illustrates a plan view of the control means of FIG. 3.

Turning now to FIGS. 3 and 4, there is shown a further aspect of the invention. In this aspect the toy comprises a playbase 102 with a top side 104 and underside 106, and an article (not shown but as previously described) which is provided to be movable along the top side of the playbase. Provided on the underside of the playbase is a control means 110 which is enclosed by panel 112.

In the control means arrangement shown, there is provided at one end of the same a housing 116 in which is provided at least one magnet 118 for creating a magnetic force on a magnet mounted in the article on the top side of the playbase so that the movement of the magnet 118 of the control means causes the article to follow the movement in the manner previously described.

The control means also includes an actuating means 120 to allow movement of the control means by the person playing with the toy. The actuating means 120 is connected to move a first plate 122. The first plate 122 is movable in linear direction relative to the playbase 102 by movement of pin 124 along a slot 126 in the panel 112. The plate is also provided to be rotatably movable relative to the playbase 104 within a limited scope defined by the movement of pin 128 of a second plate 129 in arcuate slot 130. The second plate is also linearly movable with pin 131 movable along slot 132 in panel 112 and is provided in fixed location with the first plate 122 via pin and socket 134, 136.

The second plate is pivotally connected to actuate a first lever member 138 which has one end pivotally connected to a second lever member 140. The second lever member 140 is pivotally secured in position with the playbase 104 via pin and socket 142, 144 and also pivotally connected to a third lever member 146. The first and third lever members, at the opposite ends to those attached to a lever member 140, are pivotally connected to a fourth lever member 148 at spaced points thereon. At one end of the fourth lever member 148 are provided housing 116 and magnet 118.

By providing the control means in the pantograph lever manner shown it is possible for the magnet 118 to be swept across substantially the entire area of the underside 106 of the playbase 102. Thus it will be appreciated that the article on the top side of the playbase 102, which follows the movement of the magnet 118, will also be movable across substantially all of the top side of the playbase.

The aspects of this application represent significant improvements on the conventional toys of this type and by allowing the possible uses of the top side of the playbase to be increased in terms of available area for movement and the shape of the said area along which the article can be moved so adding to the realism and enjoyment of the toy to the child.

What is claimed is:

1. A toy comprising:

a playbase having a top side and an underside, an article movable about said top side and having a first magnet mounted therein; and a control means provided on the underside of said playbase, said control means comprising a first end including an actuating means, a distal second end having a second magnet, and a pair of levers extending between the first and second ends, said actuating means comprising a first plate and a second plate movably connected to said first plate, said first plate adapted to provide limited rotating action relative to the second plate and a linear movement relative to the playbase, said second plate adapted to provide a limited linear movement relative to said playbase, and at least one of said lever members is pivotally secured to the playbase, thereby allowing the second magnet to be moveable about the underside of the playbase.

2. A toy according to claim 1 wherein a selected one of the first or second plate includes a pin and a non-selected first or second plate includes an arcuate slot formed therein for receipt of the pin and wherein rotating movement of the first plate relative to the second plate is limited to the movement of the pin in the arcuate slot.

3. A toy according to claim 1 wherein a selected one of the first or second plate includes a pin and a non-selected one of the first or second plate includes a linear slot formed therein for receipt of the pin and linear movement of the first plate relative to the playbase is determined by the movement of the pin in the linear slot.

4. A toy according to claim 1 wherein the underside includes a housing enclosing the control means and having a linear slot formed therein and wherein the first or second plate comprise a pin adapted to be received within the linear slot whereby linear movement of the first or second plates relative to the playbase is determined by the movement of the pin in the linear slot.

5. A toy comprising:

a playbase having a top side and an underside;

an article on said top side and having a magnet mounted therein; and control means for exerting a magnetic moving influence on the article to move the same along the top side of the playbase, said control means mounted on the underside of the playbase and including actuating means for providing a rotating action and linear movement thereby allowing the control means to move the article substantially across all the top side of the playbase.

* * * * *